United States Patent [19]

Fifer

[11] 4,438,610

[45] Mar. 27, 1984

[54] CLAMPED ACCESS FLOOR PANEL ASSEMBLY

[76] Inventor: James T. Fifer, #1001 1200 Boylston Ave., Seattle, Wash. 98101

[21] Appl. No.: 368,371

[22] Filed: Apr. 14, 1982

[51] Int. Cl.[3] ..... E04B 5/43

[52] U.S. Cl. ..... 52/263; 52/126.6

[58] Field of Search ..... 52/126.6, 263

[56] References Cited

U.S. PATENT DOCUMENTS

| | | | |
|---|---|---|---|
| 2,582,657 | 1/1952 | Serner | 261/114 |
| 2,956,652 | 10/1960 | Liskey, Jr. | 189/34 |
| 3,014,564 | 12/1961 | Thomsen et al. | 189/88 |
| 3,080,021 | 3/1963 | Muir | 189/34 |
| 3,251,163 | 5/1966 | Russell | 52/282 |
| 3,396,501 | 8/1968 | Tate | 52/173 |
| 3,420,012 | 1/1969 | Liskey, Jr. et al. | 52/126 |
| 3,470,663 | 10/1969 | Tate | 52/126 |
| 3,616,584 | 11/1971 | Sartori et al. | 52/126 |
| 3,780,480 | 12/1973 | Cvijanovic et al. | 52/263 X |
| 4,074,488 | 2/1978 | Ray | 52/263 |

FOREIGN PATENT DOCUMENTS

| | | | |
|---|---|---|---|
| 102226 | 7/1963 | Norway | 52/126.6 |
| 876117 | 8/1961 | United Kingdom | 52/126.6 |
| 1432075 | 4/1976 | United Kingdom | 52/126.6 |

OTHER PUBLICATIONS

Product Brochure—Tate Access Floor Systems, Apr. 1980, pp. 8, 9.

*Primary Examiner*—J. Karl Bell

*Attorney, Agent, or Firm*—Eugene D. Farley

[57] ABSTRACT

A clamped access floor panel assembly for mounting an access floor a spaced distance above a base floor. A plurality of panels are supported by an array of pedestals to form a floor surface. The panels are clamped to the pedestals at their corners and optionally at their side edges by clamping devices accessible through small access holes.

14 Claims, 17 Drawing Figures

FIG. 1
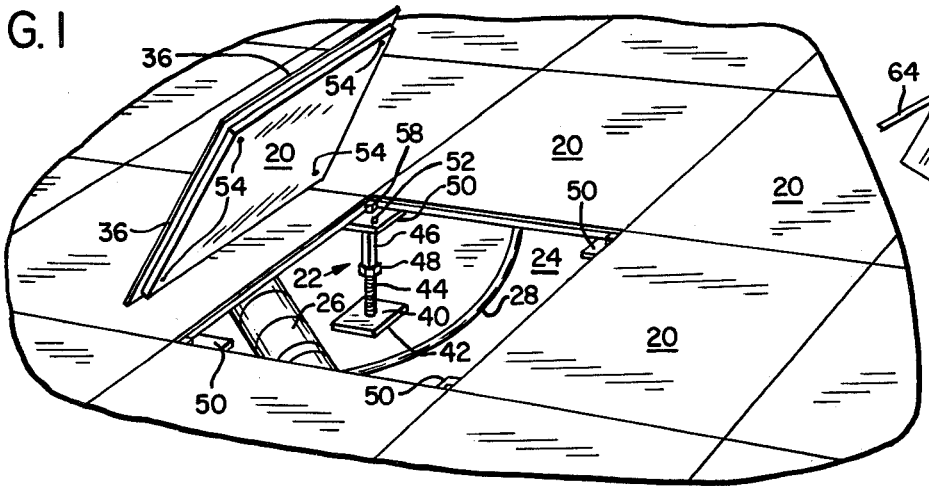
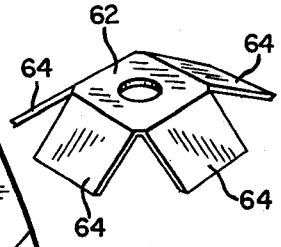
FIG. 6
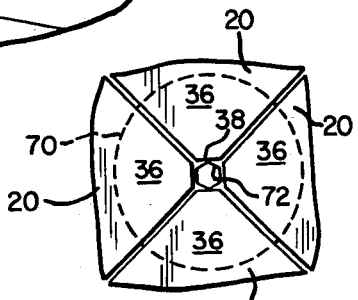
FIG. 5
FIG. 2
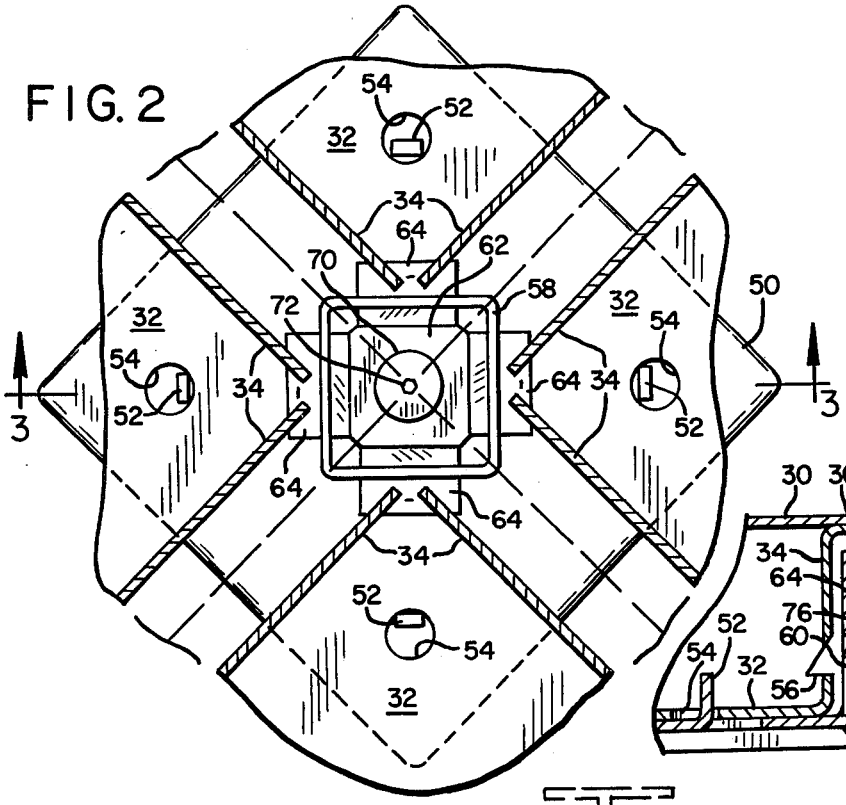
FIG. 4
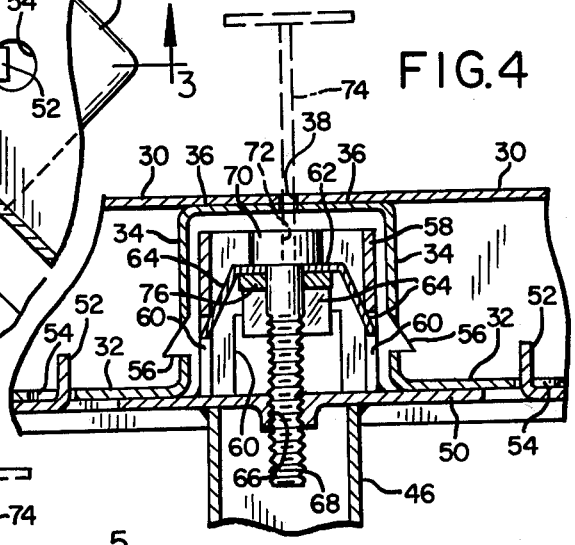
FIG. 3
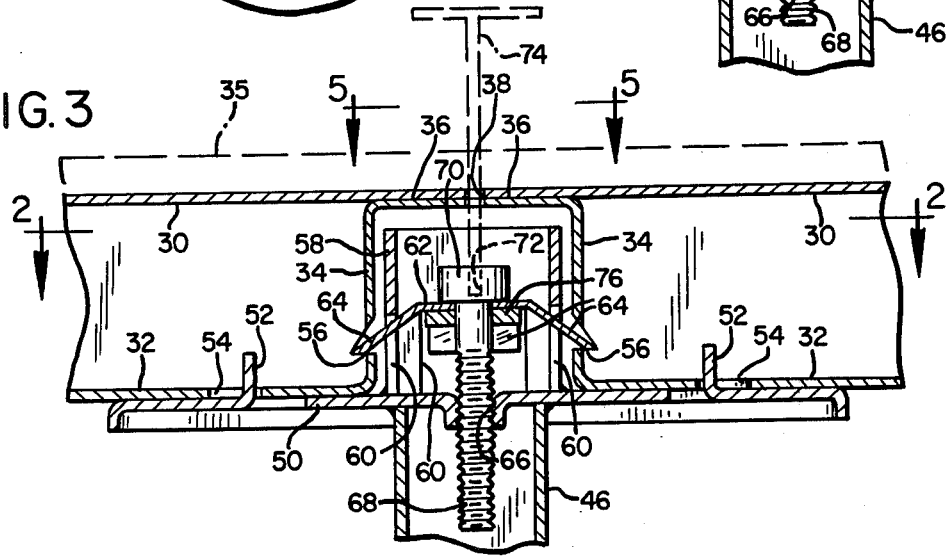

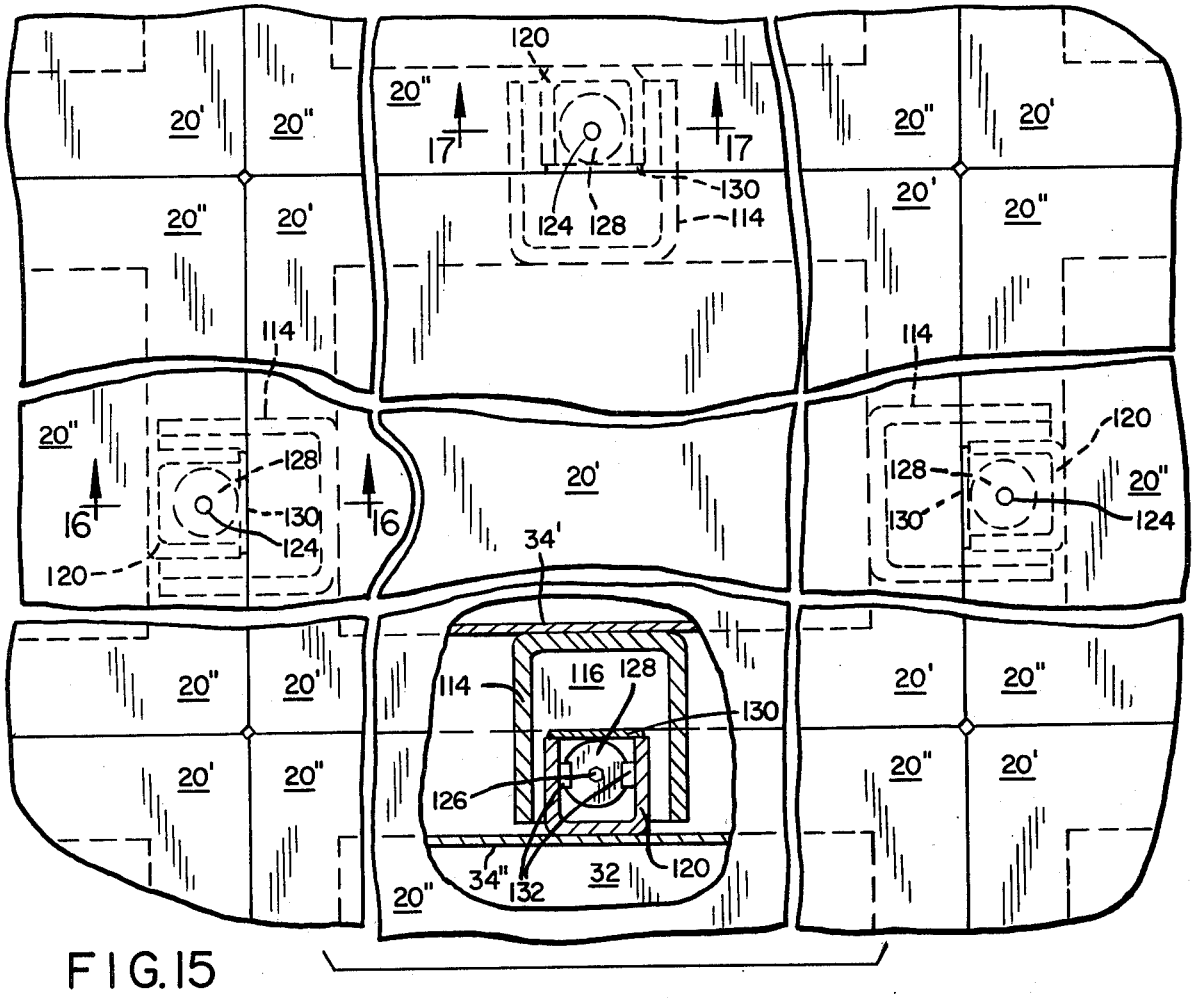
FIG. 15
FIG. 16
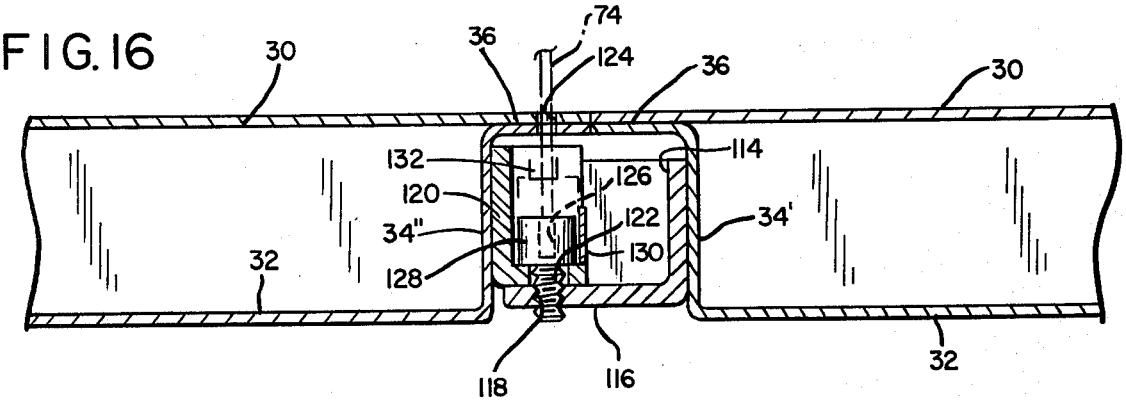
FIG. 17
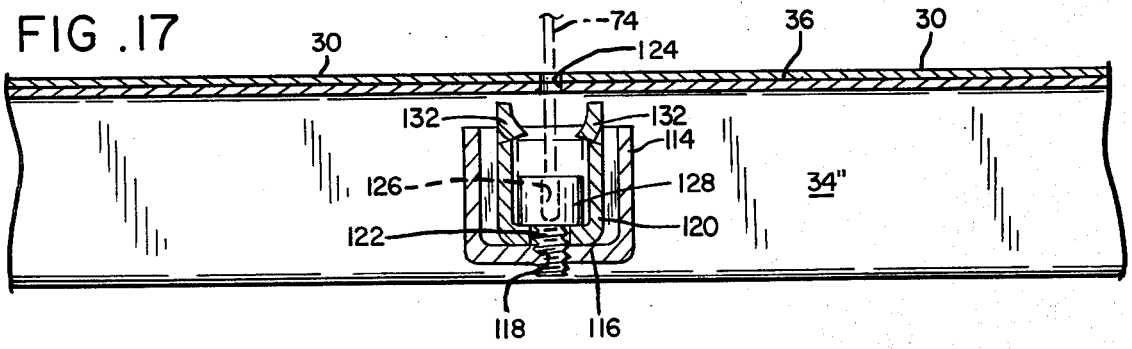

CLAMPED ACCESS FLOOR PANEL ASSEMBLY

BACKGROUND OF THE INVENTION

This invention relates to access floor panel assemblies.

Access floor assemblies of the general class of the present invention are well known in the prior art. Such flooring has been manufactured for many years and is used extensively in computer and control rooms, and more recently in general office areas.

Generally, such assemblies include an array of panels supported on pedestals a short distance above a base floor. The panels form a false floor having a space or plenum between the false floor and the base floor. The plenum can be used for the distribution of air, ductwork, electrical power, communication wiring, computer interconnect cabling, etc. Each panel is individually removable for easy access to the ductwork and wiring and to allow quick, low-cost relocation of outlets for the distributed items.

Some prior art assemblies have stringers between pedestals on which the panels are supported. This serves to make the floor more rigid, but creates a problem in laying additional wiring or ductwork since both the panels and the stringers need to be removed to allow easy access to the plenum.

The prior art panels are maintained in position by simple gravity placement, or by being bolted to pedestals or to a combination pedestal and stringer network.

Oftentimes the prior art access floor will settle with age, or as heavy equipment is moved across it. This makes the access panel surface uneven and prone to rock and to make noise when walked upon. Subsequently made pedestal adjustments to compensate for this are time consuming, disruptive of office routine, and expensive.

Normally, the metal access floor panels are covered with a flooring material.

Hard surface coverings are desirable in some installations, such as in computer rooms. The prior art bolt down systems cannot be used satisfactorily in computer rooms with hard surface coverings because access to the hold down bolts is not readily available.

Bolt down systems typically have been used only with free lay carpet tile. However, the free lay tile do not necessarily have the same dimensions as the access floor panels, and consequently are not readily transferred with the panels when changing the location of a distributed item.

Another type of flooring material comprises carpet squares which are factory-bonded to the panels and trimmed flush with the panel edges. Factory-bonded carpet squares may be bound at their edges with a protective trim. As in the case of the hard surface coverings, factory-bonded carpet does not allow easy access to the hold down bolts in a bolted installation.

Accordingly, it is the general object of the present invention to provide a clamped access floor panel assembly having the "no-rocking" advantages of a bolt down system, while allowing the use of any type of floor covering desired.

Another object is to provide easily accessible clamping means at the corners and edges of access floor panels for releasably securing the panels to supporting pedestals.

A further object is to provide a clamped access floor assembly which conforms to the industry standards for such products.

A still further object is to provide a simple, inexpensive, clamped access floor assembly which is easy to install, is relatively maintenance free, and is easily removable for modifications of the underfloor distributed items.

These and other objects and advantages of the present invention, and the manner in which they are accomplished, will be made apparent in the following specification and claims.

SUMMARY OF THE INVENTION

In its basic concept, the present invention is a clamped access floor panel assembly including an array of panel-supporting pedestals extending upwardly from a base floor to a substantially common height, a plurality of panels arranged side by side in rows and supported by the pedestals, and clamping means securing the panels to the pedestals and/or to each other, the clamping means being accessible through small access holes for securing and releasing the panels.

BRIEF DESCRIPTION OF THE DRAWINGS

FIG. 1 is a fragmentary top perspective view of a clamped access panel assembly according to the present invention.

FIG. 2 is a fragmentary section taken along the line 2—2 of FIG. 3 and illustrating a first embodiment of corner clamping means employed in the presently described access panel assembly.

FIG. 3 is a fragmentary sectional elevation taken along the line 3—3 of FIG. 2.

FIG. 4 is a fragmentary sectional elevation similar to FIG. 3 showing the retracted position of the clamping means.

FIG. 5 is a fragmentary top plan view illustrating the small access opening positioned at the vertices of adjacent panels and used when adjusting the clamping means.

FIG. 6 is a top perspective view of a resilient, star-shaped clamp plate used in the first embodiment of the corner clamping means.

FIG. 15 is a fragmentary top plan view illustrating the application of edge clamping means to the floor panel assemblies of the present invention.

FIG. 16 is a fragmentary section taken along the line 16—16 of FIG. 15.

FIG. 17 is a fragmentary section taken along the line 17—17 of FIG. 15.

DESCRIPTION OF THE PREFERRED EMBODIMENTS

Figure 8:
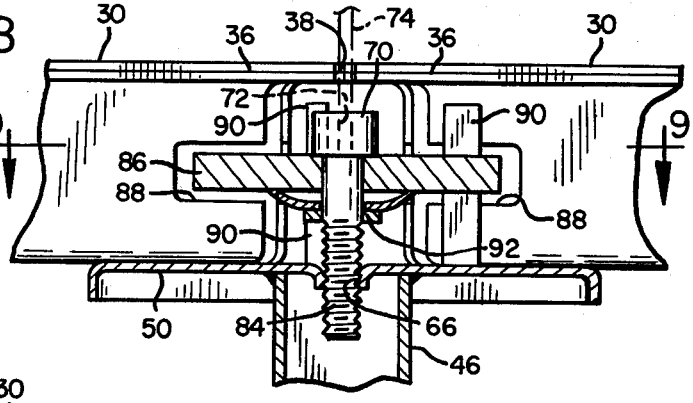
FIG. 8 is a fragmentary sectional elevation, taken along line 8—8 of FIG. 9, of a third embodiment of the corner-clamping means of the present invention.

As shown in FIG. 1, the access panel assembly of the present invention includes an array of panels 20 supported on pedestals, shown generally at 22, above a base floor 24. A plenum is formed between the base floor and the panels. This space may be used to distribute such items as ductwork 26 and wiring 28.

Panels 20 are arranged side by side in rows to cover the entire room area. Each panel is polygonal, preferably square with substantially right-angle corners, and configured to closely abut adjacent panels. As shown best in FIG. 3, each panel includes a top plate 30, a bottom plate 32 and connecting means such as edgewall 34 connecting the top and bottom plates at their edges. Surface covering 35 overlays the top plate.

A flange 36 is provided, extending over the top of pedestal 22, as an extension of the top plate. As best shown in FIG. 5, flanges 36 of four adjacent and abutting panels 20 substantially cover the top of the pedestal.

However, a small hole 38 is left at the ventices of the panels for accessing the hereinafter described clamp assemblies. As best shown in FIG. 5, the corner of flange 36 of each panel is truncated in such a manner that when the panels are placed together, access hole 38 is formed. To be unobtrusive, the access hole necessarily is small, less than the diameter of the clamping apparatus which is actuated therethrough. Thus, in a typical instance the hole may be of the order of ⅛ inch in diameter, but may be larger or smaller depending upon such factors as the nature of the floor covering material and the clamping force desired.

Pedestals 22 (FIG. 1) include a foot 40 which may be anchored in position on the base floor by an adhesive 42. A lower shaft 44 is mounted vertically on the foot and is telescoped with an upper shaft 46. A nut 48 threaded on the lower shaft locks the shafts in the desired relative position. A substantially horizontal plate 50 is mounted on the upper shaft. The top of the plate forms a panel-supporting surface.

As shown best in FIGS. 2 and 3, horizontal plate 50 includes an upstanding locator tab 52 for each corner of each panel 20, configured to engage a hole 54 in bottom plate 32 of the panel. This assures that all four panels will be aligned properly, closely adjacent to one another.

A clamping means is provided on each pedestal which engages the panels supported thereby to lock the panels releasably on the pedestal. The clamping means is accessible through the access hole as required for securing or releasing the panels.

A step is provided in the edges of the panel 20, providing a bearing surface engaged by the clamp means, which in operation applies a downward pressure on such surfaces.

FIGS. 1 through 6 illustrate a first embodiment of the panel clamping means of the present invention.

As illustrated in FIG. 3, the step engaged by the clamping means comprises a notch 56 in the corner of edge wall 34. A guide housing 58 is mounted on the pedestal and extends upwardly therefrom. It includes slots 60 opening outwardly toward each corner of the pedestal. A resilient, star-shaped clamp plate 62 (FIG. 6) having legs 64 is mounted within the guide housing with one of its legs 64 projecting through each slot 60.

Horizontal plate 50 has a threaded hole 66 through its center. This mounts a threaded interengaging member such as bolt 68. Bolt 68 includes a head 70 having a small hex socket 72 in its top (FIG. 5). A small Allen wrench 74 thus may be inserted through access hole 38 for engagement with bolt 68.

Bolt 68 rotatably engages the resilient star-shaped clamp plate 62. A retainer 76 mounts on the bolt and rotatably mounts the star clamp between bolt head 70 and the retainer. Operation of bolt 68 raises the star clamp and retracts legs 64 as shown in FIG. 4, or presses the star clamp down to extend the legs as shown in FIG. 3.

In their extended position legs 64 abut the steps or notches 56 in the edge wall 34 of the panel. Panel 20 is thus clamped between the resilient star clamp and plate 50.

It should be noted that the clamping means simultaneously locks all four panels resting on a pedestal. At the same time it exerts a slight outwardly directed force which tends to keep the panels from touching and grating against each other.

Figure 7:
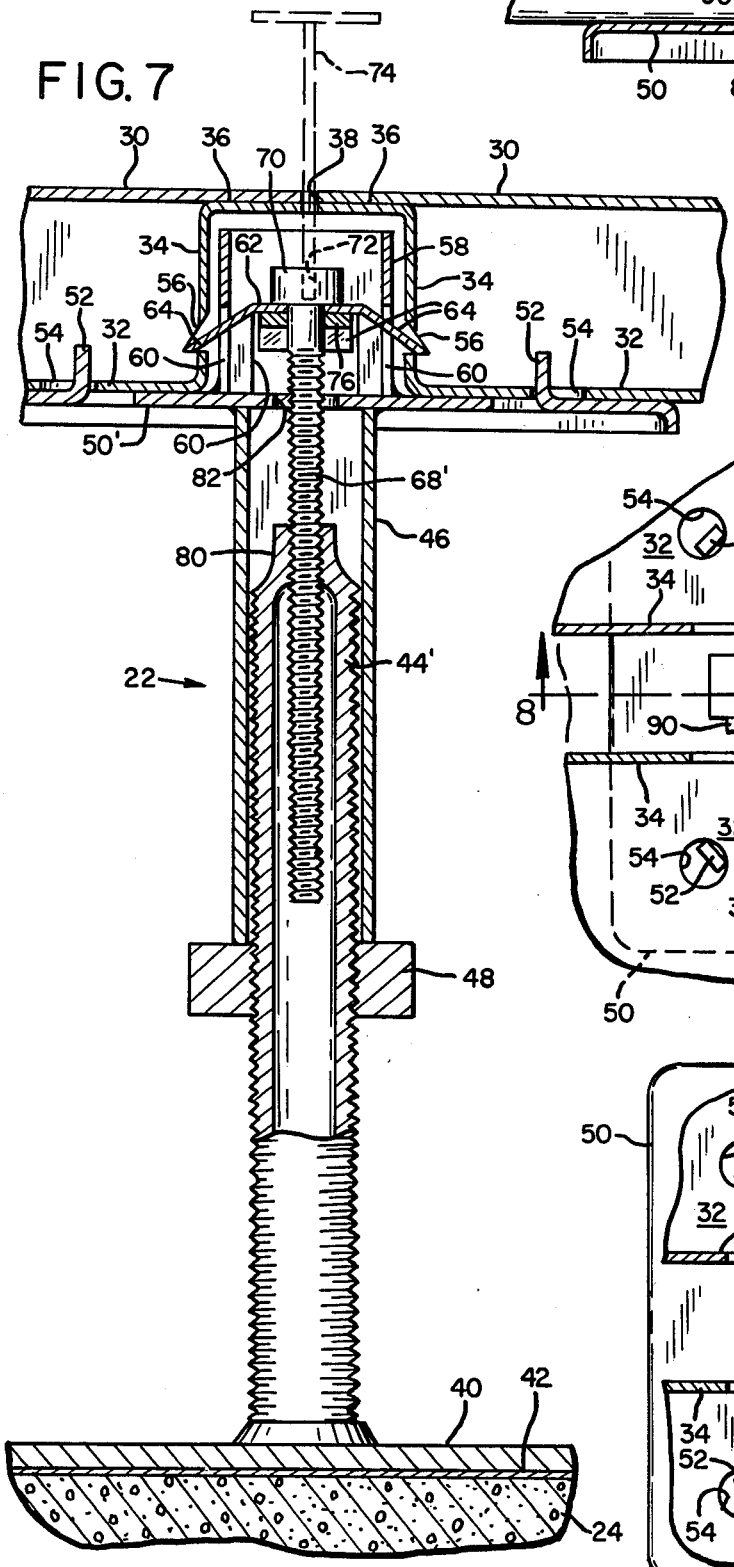
FIG. 7 is a fragmentary sectional elevation similar to FIG. 3 illustrating a second embodiment of the corner-clamping means of the present invention.

FIG. 7 illustrates a second embodiment of the present invention in which the entire pedestal is locked together by the clamping action. Lower shaft 44′ is closed at its upper end 80 and threaded to receive a long bolt 68′. Bolt 68′ penetrates a hole 82 in plate 50′ for engagement with shaft 44′.

Figure 9:
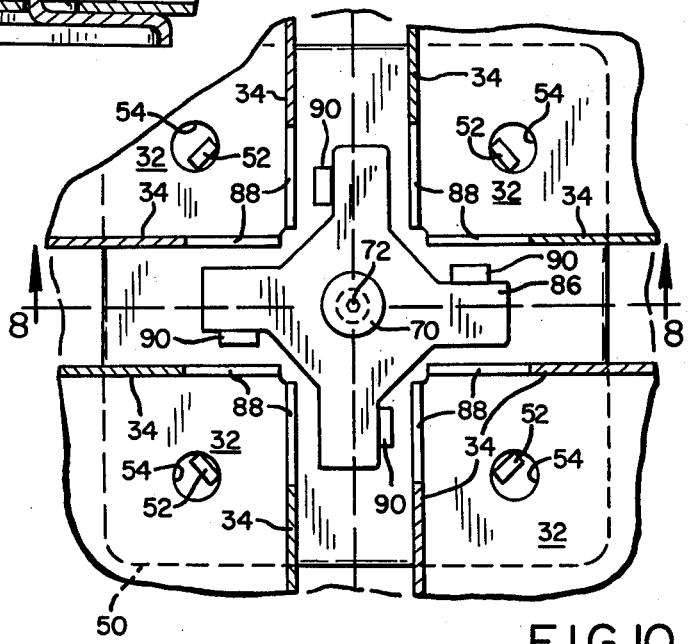
FIG. 9 is a fragmentary top plan view, similar to FIG. 2, of the clamping apparatus of FIG. 8, as shown in section taken along the line 9—9 of FIG. 8.
Figure 10:
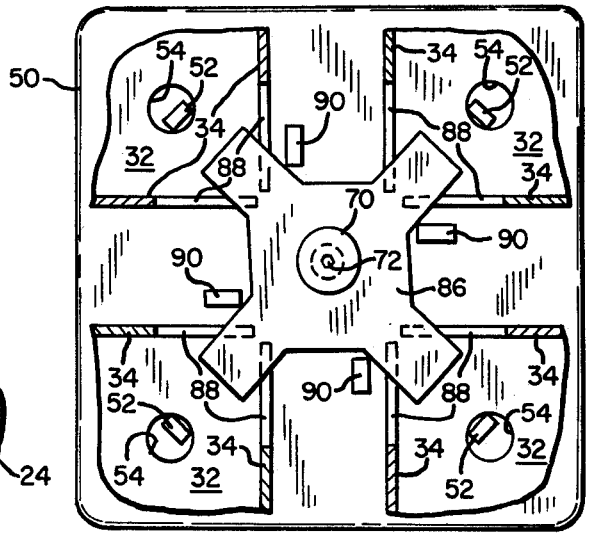
FIG. 10 is a sectional fragmentary top plan view similar to FIG. 9 showing the clamping means in its operative, clamped position.

FIGS. 8–10 illustrate a third embodiment of the panel clamping means of the present invention. As with the embodiments previously discussed, a threaded interengaging means such as bolt 84 is oriented vertically and threaded into the pedestal in plate 50. The bolt is aligned with access hole 38 and includes a hex socket 72 by means of which the clamping means may be actuated.

A rotatable, star-shaped clamp plate 86 is mounted rotatably on the bolt. It moves angularly between a first position engaging steps or notches 88 in the corners of the panel (FIG. 10) and a second position free of the steps (FIG. 9). The clamp plate is configured to abut stops 90 in either the locked or unlocked position.

A frictional clutch means 92 mounts on bolt 84 and provides sufficient friction between the bolt and clamp plate 86 to turn the clamp plate with the bolt from the first position to the second position, or vice versa, but then allows the bolt to continue turning once the clamp plate abuts stops 90. Upon further turning of the bolt the clamp plate is moved vertically to clamp or release the steps in the panel.

Figure 11:
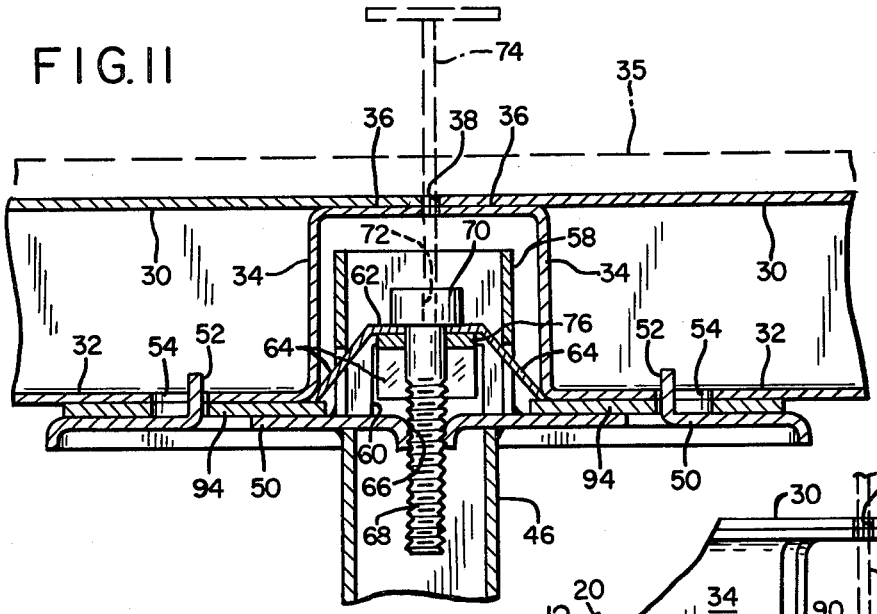
FIG. 11 is a fragmentary sectional elevation similar to FIG. 3 illustrating a fourth embodiment of the panel corner clamping means of the present invention.

FIG. 11 illustrates a fourth embodiment of the present invention, which is similar in many respects to the first embodiment shown in FIG. 3. In this embodiment the steps are formed by a flange 94 attached to bottom plate 32 of panel 20 and extending longitudinally beyond the edge of the bottom plate. Legs 64 of the resilient, star-shaped clamp plate 62 engage the flange.

Figure 13:
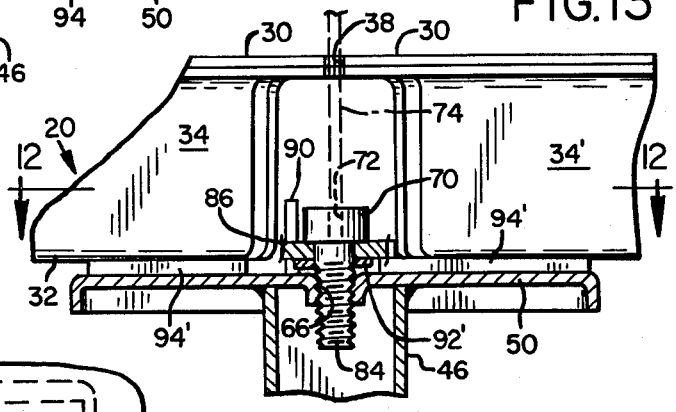
FIG. 13 is a fragmentary sectional elevation, taken along the line 13—13 of FIG. 12.
Figure 12:
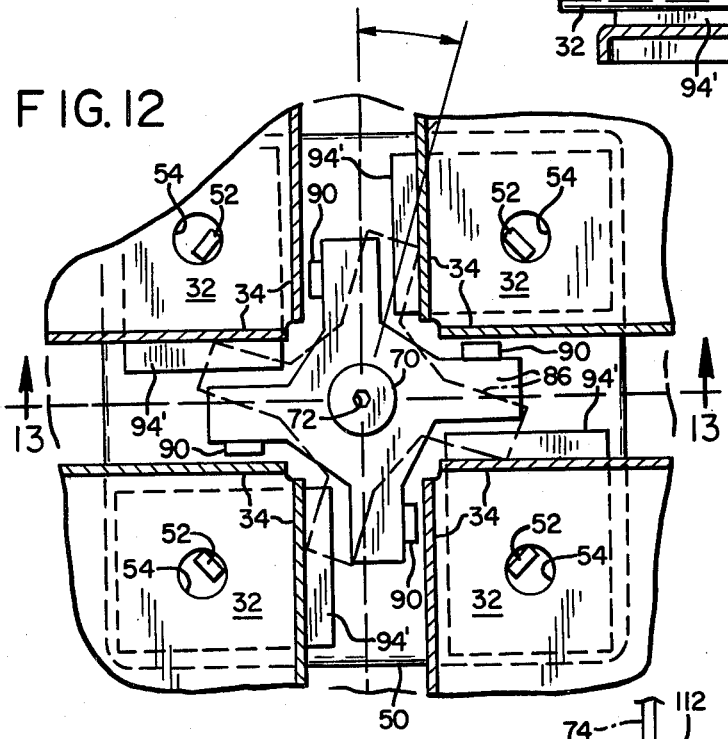
FIG. 12 is a fragmentary top plan view, similar to FIG. 9 and taken along the line 12—12 of FIG. 13, illustrating a fifth embodiment of the panel clamping means of the present invention.

FIGS. 12 and 13 illustrate a fifth embodiment of the present invention which is similar in many respects to the third embodiment as illustrated in FIGS. 8–10. Rotatable clamp plate 86 engages flanges 94′ in its operative position as shown in phantom lines in FIG. 12.

Alternatively, it can be raised and turned by action of frictional clutch means 92' to the position where it is free of the flanges.

Figure 14:
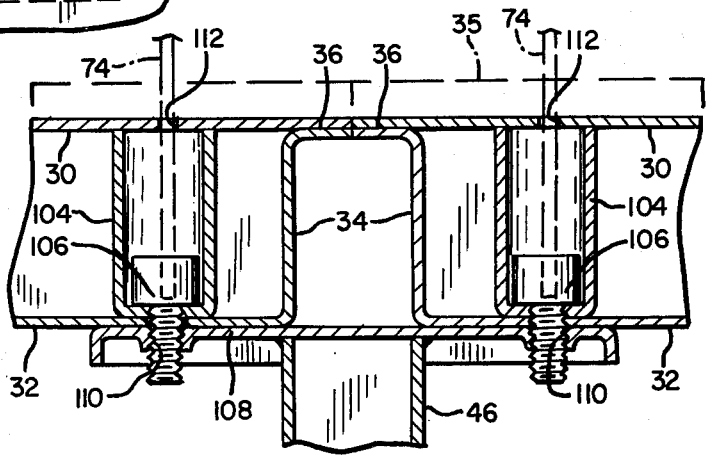
FIG. 14 is a fragmentary sectional elevation similar to FIG. 3 illustrating a sixth embodiment of the corner clamping means of the present invention.

FIG. 14 illustrates a sixth embodiment of the panel corner clamping means of the present invention. In this embodiment the access hole is not at the vertex of the panels. Each panel has a separate clamp in each corner of the panel. Near the panel corner and over plate 108 of the pedestal the panel includes a housing 104 in which is aligned a threaded interengaging member such as bolt 106. The top of the pedestal mounts plate 108 in which there is a threaded hole 110 for each bolt 106 to engage. Each panel has a small access hole 112 aligned with the bolt in each corner of the panel. An Allen wrench 72 is operable to engage the bolt in the previously described manner.

FIGS. 15–17 illustrate an edge clamping apparatus operable to lock panels 20 together midway between their corners. Such an apparatus may be used either in conjunction with, or separately from, the corner clamping devices previously discussed.

It is to be noted that in FIG. 15 the majority of the panels have been broken away to emphasize the detail of the edge clamps.

Panel 20' is shown as the central panel, with panels 20'' on each of the four sides of panel 20'. Panels 20' and 20'' are arranged in a checkerboard pattern, each type alternating with panels of the other type. The edge clamps are arranged in sets, with one half of each set on each side of panel 20', and the other half of the set on adjoining panels 20''.

The portion of the device attached to panel 20' includes a U-shaped channel 114 mounted on edge wall 34' as shown in FIG. 16. The channel includes a lower portion or lip 116 which underlaps the flange 36 area of the adjacent panel. The lip includes a threaded hole 118.

The other half of the edge clamp set includes a bracket 120 mounted on edge wall 34'' and overlapping lip 116. A threaded interengaging member such as bolt 122 is mounted rotatably through the bracket and engages threaded hole 118.

A small access hole 124 is located vertically above the bolt and allows an Allen wrench 74 to engage a hex socket 126 in the head 128 of bolt 122.

A retaining wall 130 is attached to the bracket to hold bolt 122 aligned with the hole when in a released or unscrewed position. Ears 132 are formed in the bracket to also confine bolt 122.

OPERATION

The first step in installing an access floor of the present invention is to mount a plurality of pedestals 22 in a predetermined array on the base floor 24 of the area to be covered. The pedestals are then adjusted for height so that the panel supporting surfaces (plates 50) of all pedestals are at a common height.

Next the panels are placed on the pedestals, and the precise location of the pedestals is set by arranging the panels. The foot 40 of the pedestals is glued with adhesive 42 to the base floor. As the panels are placed, the clamps are engaged. This firmly secures the entire floor into a solid sheet.

Should it be desired to access the plenum, the clamps around one of the panels are loosened and that panel can then be lifted out.

It can be seen that the clamped access floor of the present invention offers many advantages over the prior art. The clamping devices are hidden below the surface of the panels, yet are readily accessible through almost invisible access holes. Any type of floor covering may be used; with carpet particularly, the access holes are completely hidden by the fiber of the carpet. Perhaps most importantly, the access floor is stabilized to prevent rocking of the panels and eliminate costly maintenance.

Having described my invention in its preferred embodiments, I claim:

1. A corner clamped access floor panel assembly for mounting an access floor at a spaced distance above a base floor, the assembly comprising in combination:

(a) a plurality of panel supporting pedestals positioned at spaced intervals on the base floor and extending upwardly to substantially a common height, each pedestal including a panel-supporting surface adjacent its upper end;

(b) a plurality of polygonal panels arranged side by side in rows, each panel being supported at each corner by the panel supporting surface of one of the pedestals, each panel having a top surface and a clamp surface spaced below the top surface and overlying the support plate, (c) rotatable clamping means releasably interengaging the support plate and clamp surface for releasably locking the panels on the pedestal, (d) a rotary drive tool connector on the clamping means facing the top surface of the panel, and (e) a drive tool access hole through the top surface in substantially vertical alignment with the connector for rotating the clamping means between an operative position locking the panels on the pedestal and a release position unlocking the panels from the pedestal.

2. The assembly of claim 1 wherein the access hole is formed by each panel having its top surface corners truncated such that when the panels are placed together the truncated corners form an opening at the vertices of the panels.

3. The assembly of claim 1 wherein each panel comprises top and bottom plates, connecting means connecting the plates at their margins, an extension of the top plate forming an upper flange, and further comprising a step in the edges of the panel adjacent each corner providing a bearing surface positioned for engagement by the clamping means operable to be engaged to apply a downward pressure thereto.

4. The assembly of claim 3 wherein the step comprises a notch in the connecting means adjacent each corner of the panel between the top and bottom plates.

5. The assembly of claim 3 wherein the step comprises a flange attached to the bottom plate and extending longitudinally beyond the edge of the bottom plate.

6. The assembly of claim 3 wherein the clamping means comprises:

(a) a guide housing attached to the top of the pedestal and including a slot opening outwardly toward the corner of each panel;

(b) a resilient, star-shaped clamp plate mounted within the guide housing and having a leg projecting through each slot; and (c) threaded interengaging means threaded vertically into the pedestal and rotatably engaging the star clamp and operable to press it downwardly, forcing the legs outwardly into engagement with the steps in the edges of the panels, the threaded interengaging means having the drive tool connector aligned with the access hole in the panels.

7. The assembly of claim 6 wherein the pedestal is adjustable in height, having an upper shaft and a telescoping lower shaft, and wherein the threaded interengaging means is threaded into the lower shaft.

8. The assembly of claim 3, wherein the clamping means comprises:

(a) a threaded interengaging means oriented vertically and threaded into the pedestal and aligned with the access hole in the panels;

(b) a rotatable, star-shaped clamp plate mounted rotatably on the threaded interengaging means and operable to move angularly between a first position engaging the steps in the edges of the panels and a second position free of said steps; and (c) frictional clutch means between the threaded interengaging means and the clamp plate providing sufficient friction to turn the clamp plate with the threaded interengaging means from the first position to the second position and vice versa, but to allow the threaded interengaging means to continue to rotate once the clamp plate reaches one or the other position, whereby upon further turning of the threaded interengaging means the clamp plate is moved vertically to clamp or release the steps.

9. The assembly of claim 1 wherein the pedestal comprises an upright shaft and a substantially horizontal plate attached to the upright shaft, the top of the plate forming the panel supporting surface.

10. The assembly of claim 9 wherein each panel has a plurality of access holes therein, each hole being near a corner of the panel, and wherein the clamping means comprises a threaded interengaging member aligned with the access hole and mounted rotatably in the clamp surface of the panel and threaded into the plate of the pedestal.

11. The assembly of claim 10 wherein the access hole is smaller in diameter than the threaded interengaging member.

12. An edge-clamped access floor panel assembly having edge interlocking apparatus on the panel edges between corners for stabilizing the floor, the access floor being mounted a spaced distance above a base floor, the assembly comprising:

(a) a plurality of panel supporting pedestals positioned at regular intervals on the base floor and extending upwardly to substantially a common height;

(b) a plurality of polygonal panels arranged side by side in rows and being supported by the pedestals at the corners of the panels, the panels having a top plate and an inset, downwardly extending marginal edge wall defining a marginal flange portion of the top plate; and (c) edge clamps interlocking pairs of adjacent panels, the edge clamps arranged in sets and including:

(1) a lip attached to the edge wall of one of the panels and underlapping the other panel;

(2) a bracket attached to the edge wall of the other panel and configured to overlap the lip;

(3) a threaded interengaging member mounted rotatably through the bracket and threaded into the lip whereby the bracket and lip may be clamped together; and (4) an access hole in the marginal flange of the panel vertically above the threaded interengaging member.

13. The assembly of claim 12 wherein the access hole is smaller than the threaded interengaging member.

14. The assembly of claim 12 wherein the panels are of two types, a first type having lips on all four edges and a second type having the mating bracket and threaded interengaging assembly on all four edges, and wherein the panels of each type are arranged in a checkerboard pattern, alternating with the panels of the other type.

* * * * *